United States Patent [19]

Dubuc

[11] Patent Number: 4,846,356

[45] Date of Patent: Jul. 11, 1989

[54] RIGID CLOTHES DRYING RACK

[76] Inventor: Marie C. Dubuc, 3940, Dagenais Blvd W. #E, Laval, Quebec, Canada, H7R 1L2

[21] Appl. No.: 225,029

[22] Filed: Jul. 27, 1988

[51] Int. Cl.[4] ..... A47F 5/08

[52] U.S. Cl. ..... 211/106; 4/548; 211/119; 211/119.01

[58] Field of Search ..... 211/86, 87, 106, 119.01, 211/119, 181, 182; 4/559, 605, 548

[56] References Cited

U.S. PATENT DOCUMENTS

| | | | |
|---|---|---|---|
| 1,537,172 | 5/1925 | Kottke | 211/106 |
| 1,857,617 | 5/1932 | Berdan | 211/86 X |
| 2,271,941 | 2/1942 | Kemmitt | 211/119 X |
| 2,292,270 | 8/1942 | Hara et al. | 211/119 |
| 2,569,832 | 10/1951 | Shoener | 211/119 |
| 2,596,054 | 5/1952 | Tallman | 211/119 X |
| 2,780,365 | 2/1957 | Trainor | 211/87 |
| 3,025,969 | 3/1962 | Daley | 211/86 |
| 3,178,033 | 4/1965 | Wirsing | 211/86 |
| 3,380,595 | 4/1968 | Klausen et al. | 211/87 |
| 4,192,426 | 3/1980 | Gauthier | 211/87 |

FOREIGN PATENT DOCUMENTS

| | | | |
|---|---|---|---|
| 743419 | 9/1966 | Canada | 211/87 |
| 3618243 | 12/1987 | Fed. Rep. of Germany | 211/182 |
| 1008535 | 5/1952 | France | 211/119.01 |
| 268515 | 5/1950 | Switzerland | 211/87 |
| 20719 | of 1905 | United Kingdom | 211/87 |

*Primary Examiner*—Reinaldo P. Machado
*Assistant Examiner*—David L. Talbott
*Attorney, Agent, or Firm*—Roland L. Morneau

[57] ABSTRACT

A clothes drying rack adapted to be fixed to a ceiling and between lateral walls surrounding a bathtub. It includes a rectangular frame having cross-bars secured to the frame. The frame is supported to the ceiling by a pair of brackets having a flange in the plane of the frame. Each bracket is mounted on two opposite long sides of the frame. The frame is also supported by two pairs of S-shaped hooks slidingly mounted on the two opposite short side of the rectangular frame. These hooks have an eyelet at each end. The eyelets are twisted in planes perpendicular from each other. The frame is preferably made to be sidingly adjustable relative to the bracket and the hooks so that the rack can be installed above the bathtub while it is secured to the most solid parts of the surrounding walls and the ceiling.

5 Claims, 3 Drawing Sheets

RIGID CLOTHES DRYING RACK

BACKGROUND OF THE INVENTION

1. Field of the Invention

The invention relates to a clothes drying rack adapted to be permanently fixed to a ceiling and adjacent walls over a bathtub. The rack is made of rigid elements. The rack includes a frame with supporting means which are slidingly mounted on the frame. The points of attachment of the supporting means with the ceiling and the walls can be adjusted for more solid gripping points.

2. Prior Art

U.S. Pat. No. 2,360,455 uses a flexible line which is attached to opposite walls. The points of fixation are automatically aligned with the central axis to the hanger.

In Canadian Pat. No. 234,933, the clothes drying rack is suspended from above along an unadjustably fixed central axis relative to the perimeter of the rack.

No patent was found on clothes drying rack in which the points of fixation vary relative to the perimeter of the rack.

SUMMARY OF THE INVENTION

The clothes drying rack, according to the invention, is intended to be mounted adjacent a ceiling between lateral walls. It comprises a rigid rectangular frame to which are secured rigid cross-bars. The frame is held to the ceiling by of brackets and to the lateral walls by hooks slidingly mounted on opposite rods of the rectangular frame. The brackets are preferably secured by pairs to a plate adapted to be fixed to the ceiling. It is also within the embodiment of the invention to provide extention means to the plates for securing them to a back wall between the two lateral walls.

DETAILED DESCRIPTION OF THE DRAWINGS

Figure 1:
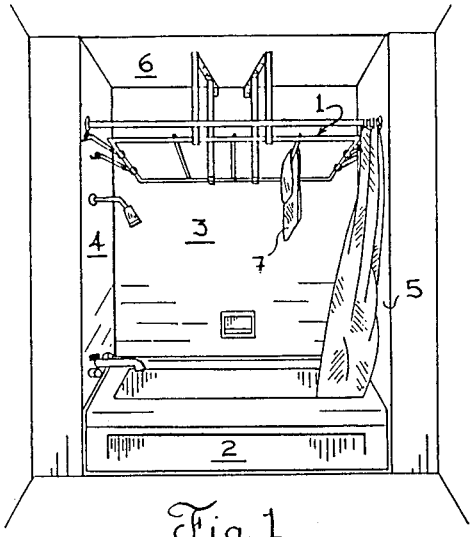
FIG. 1 is a perspective view of a clothes drying rack according to the invention mounted over a bathtub in a bathroom.
Figure 3:
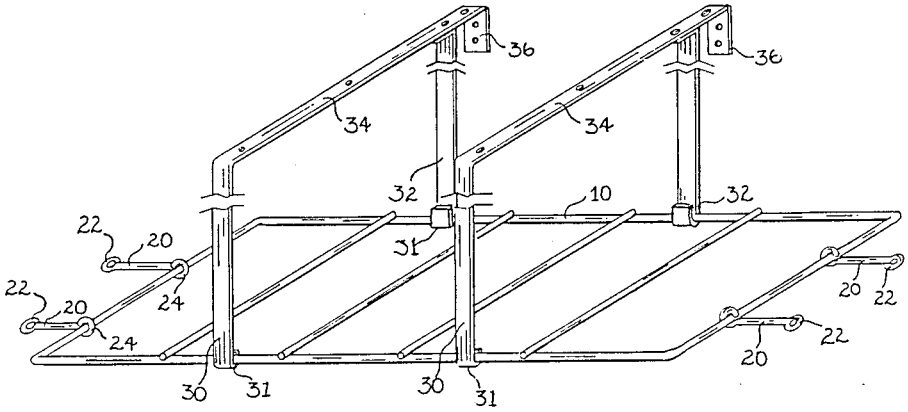
FIG. 3 is a perspective view of another embodiment of the invention.

FIG. 1 shows a clothes dring rack 1 according to the invention mounted over a bathtub 2 which is surrounded by a backwall 3 and two lateral walls 4 and 5. The rack is suspended from the ceiling 6. The periphery of the rack is generally smaller than the inner dimensions of the bathtub so that any piece of clothing such as 7 hanging from the rack would drip in the bathtub 2.

Figure 2:
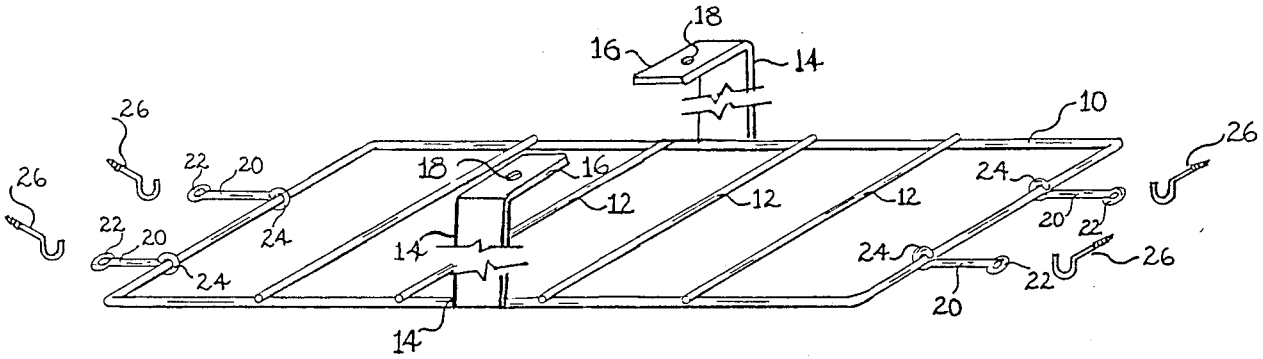
FIG. 2 is a perspective view of a clothes drying rack according to the invention.
Figure 6:
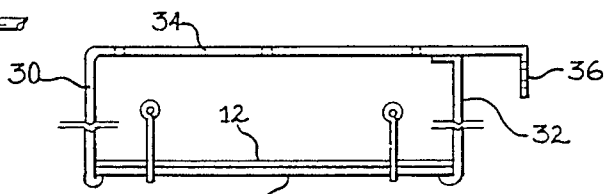
FIG. 6 is a side view of the embodiment shown in FIG. 2.

The clothes drying rack, shown in FIG. 2, is essentially made of a rectangular frame 10 having transversal cross-bars 12. The frame 10 and the cross-bars are made of rigid rods and preferably of stainless steel wires having a diameter of approximately 3/16 of an inch. The cross-bars 12 are welded to the frame 10. A frame having a length of about 50 inches and a width of about 20 inches has been found to be generally suitable for most of the bathtubs.

The frame 10 is supported by two brackets 14 welded to opposite sides of the frame. The brackets 14 have an L-shape extending upwardly over the long sides of the frame 10. The flange 16 of the bracket 14 which is in a plane substantially parallel to the plane of the frame 10 is provided with a perforation 18 adapted to receive a nail or a screw to be fastened to the ceiling.

Each short side of the frame 10 supports at least one S-shaped hook 20 having an eyelet at each end of the hook 20. The eyelets are formed by closed loops 22 and 24 which are oriented in planes substantially perpendicular from one another. The loop 24 of the hooks 20 are adapted to slide along each of the short side of the frame 10 so as to be lined up with a screw-hook 26 fixed to the lateral walls over the bathtub.

The rack 10 is intended to be fixed to the ceiling over the bathtub which is frequently surrounded by three walls. It is mounted adjacent the ceiling by the bracket 14 and the rack may be moved sideways so that perforations 18 may be alined with reinforcing battens. Afterwards, screw-hooks 26 which have been threaded in the lateral walls preferably in reinforcing battens are intended to grip an eyelet 22 of an S-shaped hook 20. Considering that the reinforcing battens in the lateral walls are not always in defined or predetermined locations, the S-shaped hook 20 are adapted to slide along the short side of the frame 10 and also adapted to angularly moved up and down.

It may be realized that the present clothes drying rack can be universally adapted over a bathtub wherein the surrounding walls are at a variety of distances from the sides of the frame 10. The rods 12 are preferably welded to the frame 10.

FIGS. 3–6 illustrate another embodiment of the invention comprising a similar frame 10 and eyelets 20 and 22. The frame 10 is supported by a pair of brackets 30 and 32 connected together by a plate 34 having a downward flange 36. The brackets 30 and 34 have a U-shaped hook at their lower end to receive the long sides of the rectangular frame 10. The plate 34 is provided with perforations for the introduction of nails or screws to secure the plate to the ceiling. The extention of the plate 34 and the flange 36 are intended to reinforce the support of the frame while maintaining the frame away from the backwall. The flange 36 is also provided with holes for securing it to the backwall. The U-shaped portion 31 of the bracket 30 allows the sliding movement of the plate 34 to be aligned, for installation with portion of the ceiling which are best suitable for receiving the nails or the screws.

Figure 7:
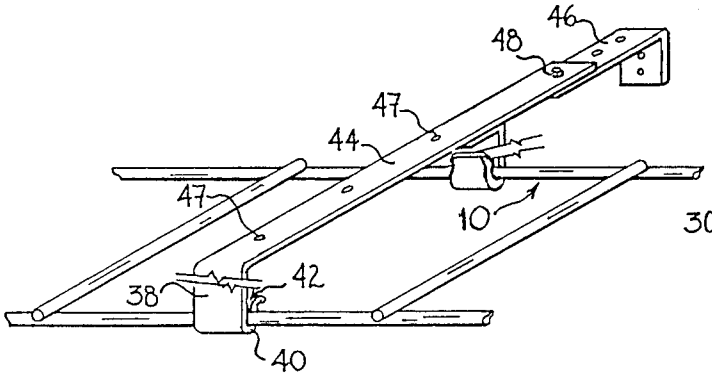
FIG. 7 is a perspective view of a different embodiment of the support of the rack.
Figure 5:
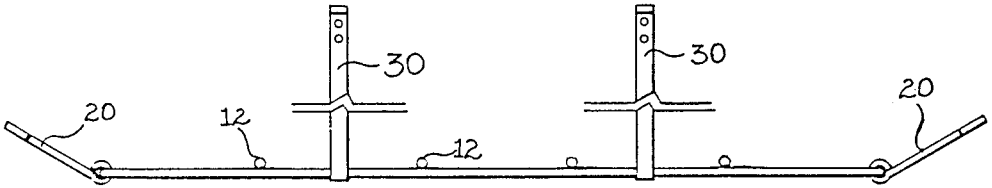
FIG. 5 is a side view of the embodiment shown in FIG. 2.
Figure 4:
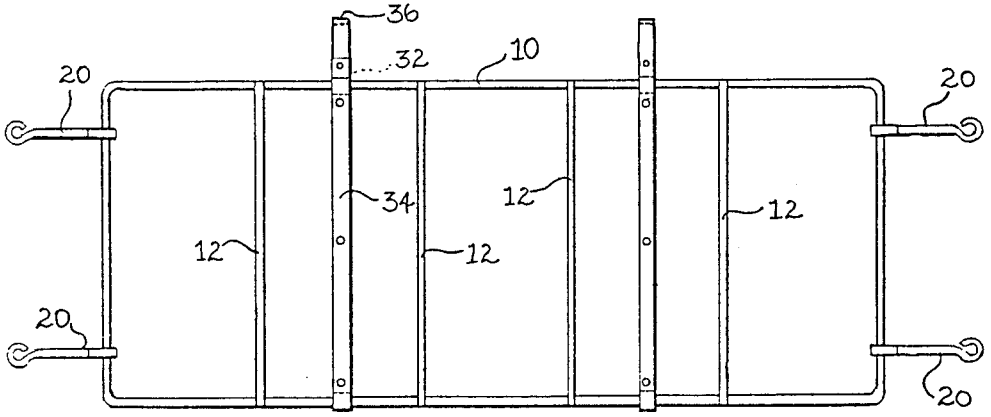
FIG. 4 is a top view of the embodiment shown in FIG. 2.

FIG. 7 illustrate a different embodiment of the supporting means for the frame 10. It differenciates from the embodiment shown in FIG. 2 in that the U-shaped portion 40 of the bracket 38 forms a restricted gap 42 having a width slightly smaller than the diameter of the rod forming the frame 10. This arrangement allows the rod of the frame 10 to elastically spread the gap 42 and enter into the U-shaped portion 40 of the bracket 38. This arrangement also enables the rod of the frame 10 to be retracted with a slight force but prevents it from unintentionally falling off the U-shape 40.

FIG. 7 also illustrates a supporting plate 44 which is provided with an adjustable extention consisting of an angular plate 46. The part of the plate 44 and the angle 46 which are adapted to be superposed are provided with a set of perforations 47 adapted to adjustably secured them together with a bolt an nut arrangement 48. Considering that all bathrooms and the location of the bathtub relative to the back wall may be different, the adjustment of the angle plate 46 is frequently usefull.

Supporting plates such as 34 and 44 may be located half way between the small sides of the frame 10 but for more rigidity of the rack, two of such plates 34 and 44 are used as illustrated in figures 3–6.

The frame is dimensioned with sides slightly smaller than the cavity of the bathtub, so that the clothes hanging or on the frame 10 or the rods 20 will drop in the bathtub. Because the present rack is intended for a permanent installation over the bathtub, any vapor or steam which may exist in the bathroom and which accumulates on the rack will also drop inside the bathtub. It is noted that the hooks 20 and 22 are normally slanted so that any water accumulating on them will drop in the bathtub.

The installation of the present rack is easy and is adaptable to a large variety of bathroom and to surfaces of the surrounding walls and ceiling which are most suitable to receive screws or nails.

I claim:

1. A clothes drying rack adapted to be fixed to a ceiling surface and between lateral walls, comprising:

a rectangular frame having cross-bars secured to said frame, the said frame and cross-bars being made of rigid rods;

at least, a pair of brackets for supporting said frame, each of said brackets having an elongated plate adapted to be secured to the ceiling, the said plate extending downwardly at both ends into a U-shaped hook for releasably gripping two opposite long sides of said rectangular frame, said plate having a slidingly adjustable extension projecting beyond the periphery of the rectangular frame, said extension forming a downward flange adapted to be secured to a backwall located between said lateral walls for adjustably spacing said frame from said backwall, said plate and said flanges being provided with perforations for securing the said rack to the ceiling and the walls respectively, at least, a pair of S-shaped hooks, one end of each of said S-shaped hooks slidingly mounted on two opposite short sides of said frame, the other end of said S-shaped hooks adapted to be fastened to lateral walls, wherein said brackets and said S-shaped hooks can be laterally moved relative to the periphery of the frame before being secured respectively to the ceiling surface and the lateral walls.

2. A clothes drying rack as recited in claim 1, wherein said S-shaped hooks have an eyelet at each end, the eyelets of each hook being twisted in planes perpendicular to each other.

3. A clothes drying rack as recited in claim 1, wherein the opening of the said U-shape forms a gap of a dimension slightly smaller than the diameter of the rod of the frame to allow said rod elastically spread said gap when entering in said U-shape.

4. A clothes drying rack as recited in claim 1, wherein rods of said frame and said cross-bars are made of stainless steel welded together.

5. A clothes drying rack as recited in claim 1, comprising two pairs of S-shaped hooks, one of said pairs of hooks being mounted on each of said short sides of the frame.

* * * * *